United States Patent [19]

McIntyre et al.

[11] Patent Number: 4,466,998

[45] Date of Patent: Aug. 21, 1984

[54] WOOD IMPREGNATION

[75] Inventors: Craig R. McIntyre, Wadsworth; Daniel A. Eakin, Wooster, both of Ohio

[73] Assignee: Koppers Company, Inc., Pittsburgh, Pa.

[21] Appl. No.: 388,748

[22] Filed: Jun. 16, 1982

[51] Int. Cl.[3] ..... B05D 1/18; B05D 3/12

[52] U.S. Cl. ..... 427/297; 427/351; 427/440

[58] Field of Search ..... 427/297, 351, 440, 441

[56] References Cited

U.S. PATENT DOCUMENTS

| | | | |
|---|---|---|---|
| 2,799,597 | 7/1957 | Walker et al. | 427/441 X |
| 3,080,212 | 3/1963 | Oberley et al | 427/440 X |
| 3,200,003 | 8/1965 | Bescher. | |
| 3,560,251 | 2/1971 | Hager | 427/351 |
| 4,303,705 | 12/1981 | Kelso | 427/440 X |

OTHER PUBLICATIONS

Rak, J.R., *Penetration by and Stability of Copper-chrome-arsenic wood preservatives*, 88:138130r, Chemical Abstracts, vol. 88, 1978

*Primary Examiner*—Michael R. Lusignan

*Attorney, Agent, or Firm*—Donald M. MacKay; Herbert J. Zeh, Jr.

[57] ABSTRACT

Water-borne preservative salts are used to impregnate wood by the empty-cell pressure impregnation method without the precipitation of water-borne salts such as chromium, copper and arsenic when wood sugars enter the treating solution during the kickback or pressure release phase of the empty-cell cycle. The lack of precipitation is obtained by maintaining the preservative salts solution at a temperature between about 40° F. and about 70° F.

10 Claims, No Drawings

WOOD IMPREGNATION

BACKGROUND OF THE INVENTION

The most successful and widely used of the pressure processes are those in which the wood treatment is carried on in closed cylinders. In general, such processes have a number of advantages over the nonpressure method. Of prime importance is the fact that, in most cases, a deeper and more uniform penetration and a higher absorption of preservative can be secured, thus providing more effective protection to the timber. Furthermore, the treating conditions may usually be so controlled that retention and penetration can be varied to meet the requirements of service, thus resulting in more economical use of preservative. Special manipulations, or preliminary treatments, within the cylinder also make it possible to impregnate unseasoned wood or to sterilize the timber. Finally, these pressure processes are adapted to the large-scale production of treated material.

While the various pressure processes differ in details, the general method of handling the material is the same in all cases. The treatment is carried on in cylinders or retorts, mostly within the limits of 6 to 9 ft. in diameter and up to 150 ft. or more in length, and built to withstand working pressures up to 250 psig. The ties, poles, structural timbers, or other forms of timber are loaded on special tram cars, which are moved about the treating yard and in and out of the cylinder on steel tracks. Storage and measuring tanks, pressure and vacuum pumps, steam boilers, and other plant equipment are also provided.

The various pressure methods used for injecting preservatives into wood in closed cylinders may be divided into two main groups, designated as full-cell and empty-cell processes. In the full-cell process, the aim is to retain as much of the liquid forced into the wood during the pressure period as possible, thus leaving the maximum concentration of preservative in the treated zone. In the empty-cell processes, on the other hand, part of the preservative forced into the timber under pressure is subsequently recovered, so that the cells tend to be coated with preservative rather than filled with it.

The full-cell process is especially advantageous when it is desired to inject as much preservative solution as the wood can take. Empty-cell methods are required when it is desired to secure as deep penetration as possible with a limited final retention of liquid. When wood is to be treated with preservative oils, the empty-cell processes are generally used.

When treating with water solution of preservative salts, it is customary to use the full-cell process and to force into the wood all of the liquid that it can hold. The desired retention (amount of dry salt per cubic foot of wood) is obtained by regulating the strength of the solution rather than by limiting the amount of liquid injected into the timber. The distinguishing characteristic of every full-cell treatment is the preliminary vacuum, the purpose of which is to exhaust the air from the cells of the wood.

As practiced today, full-cell treatment with water solutions embodies the same general procedure as with oils. The preliminary vacuum is followed by the admission of the preservative solution and the application of pressure, which may amount to as much as 200 psig. The solution temperatures range from atmospheric to 200° F., depending on the preservative used. When virtually no more preservative can be forced into the wood, the pressure is released and the cylinder drained. The strength of the treating solution generally varies from 2 to 8 percent, depending upon the amount of liquid that can be forced into the timber; for preservative purposes it is usually so regulated as to give a retention of ¼ to 2½ lbs. of dry preservative per cubic foot of wood.

The chief characteristic of the empty-cell process is the application of preliminary air pressure to the wood, prior to the injection of the preservative oil. The timber to be treated should be air dry for best results, but green material may be used, provided it is first conditioned by the steaming-and-vacuum, the boiling-under-vacuum, or other suitable method. Air is injected into the treating cylinder until the desired pressure is obtained, with the result that a certain amount is forced into the wood. The cylinder is then filled with preservative in such a way that the injected air is trapped in the wood. The filling may be accomplished by forcing the preservative into the bottom of the retort and allowing air to escape from the top just rapidly enough to maintain a constant pressure. Another way of carrying out the operation is to have the preservative in an overhead Rueping tank under the same pressure as the compressed air in the cylinder and, by means of a suitable arrangement of pipes, to allow the oil to flow into the retort by gravity while the air passes up into the space vacated by the preservative. After the filling is completed, the preservative is forced into the timber by the application of higher pressure until the desired absorption is obtained, thus further compressing the air imprisoned in the wood. The pressure is then released, the preservative drained from the cylinder, and the charge subjected to a high final vacuum for a period of 30 minutes or more. As soon as the pressure is released, the compressed air in the wood expands and forces out a considerable amount of the preservative that was injected. The final vacuum hastens the recovery of oil and also shortens the period during which the preservative will continue to drip from the timber. The maximum amount of preservative contained in the wood at the end of the pressure period is called the gross absorption; the amount expelled after the release of the pressure but without the application of vacuum is termed the kickback; the amount recovered from the wood during the final vacuum is sometimes called the drip or drain; the kickback plus the drip constitute the total recovery; and the net amount left in the wood is known as the net absorption, or net retention. As the result of this recovery, the net retention of preservative associated with a given penetration is substantially less than would be required to saturate the wood with oil to the same depth. It follows that, with a limited net retention, deeper penetration is obtained in permeable woods by the empty-cell process than by the fuel-cell treatment.

The intensity of the preliminary air pressure is governed by the character of the wood being treated and the net retention of preservative desired. When low retentions are specified in wood that is very receptive to treatment, such as the air-dry sapwood of southern pine, air pressures as high as 100 psig may be used. When more refractory woods or higher net retentions are involved, lower pressures are employed; in any given case, the precise intensity will depend largely upon the judgment of the operator, but pressures of 25 to 75 psig are most common. In some plants, the practice is to start filling the cylinder with preservatives as soon as the air pressure is built up to the desired amount; while in others, the maximum pressure is maintained for 15 to 30 minutes before filling.

The pressures employed in injecting preservatives into the wood are commonly about 100 lbs. higher than the preliminary air pressures, but it is frequently inadvisable to increase them to such an extent. The preservative pressures seldom exceed 200 psig, the maximum permitted under the specifications of the American Wood-Preservers' Association, and it is usually unnecessary to raise them above 150 lbs. With woods of low compressive strength, or green timber that has been softened by steaming, it is often desirable to set the limit at 115 to 125 lbs., since greater pressures may tend to cause collapse and checking of such material.

The amount of preservative recovered from the wood upon release of preservative pressure and application of final vacuum varies widely. It is influenced by the character and condition of the wood, the relation between the preliminary-air and preservative pressures, the temperature of the preservative and, no doubt, various other factors. Recoveries as high as 50 to 60 percent of the gross absorption are sometimes obtained, but those of 20 to 40 percent are more common.

The Lowry process differs from the empty-cell process only in the fact that it does not involve the use of an initial air pressure above the atmospheric. The preservative oil is injected into the timber without any preliminary treatment other than such conditioning as may be required when green wood is to be impregnated. The air that is naturally present in the wood is compressed during the preservative-pressure period and serves to expel part of the injected oil when the pressure is released and the final vacuum is drawn. With oils the preservative temperature should average not less than 180° F. and not exceed 220° F., and the maximum pressure is limited to 200 psig (for some species it must not exceed 150 psig). The length of time required to attain the specified pressure and the period for which it is held vary according to the kind of wood being treated and other conditions, such as the size and moisture content of the material; in general, the maximum pressure being used is maintained until the desired gross absorption is obtained. The final vacuum is usually held for a period of not less than 30 minutes.

One of the problems found with treating wood with water-borne salts such as CCA salts is that the chromium, copper and arsenic precipitates out of solution when wood sugars enter the treating solution during the kickback or pressure release phase of the empty-cell cycle. For this reason the AWPA requires that a full-cell cycle be used with water-borne salts. The problem with using the full-cell cycle is that it adds 25 to 30 pounds of solution to the wood during the treating cycle, which requires that the treated wood be subjected to a prolonged period of seasoning to reduce the weight to a reasonable shipping level or the treated wood is shipped at an expensive high shipping weight.

BRIEF DESCRIPTION OF THE INVENTION

It has now been discovered that an empty-cell process can be employed to treat wood with water-borne treating solutions containing salts such as CCA salts without the salts precipitating out of solution. More particularly, it has been found that if the temperature of the treating solution is maintained at no more than about 70° F. that the precipitation can be obviated or reduced to a level which can be controlled without undue expense.

DETAILED DESCRIPTION OF THE INVENTION

While the invention is particularly advantageous for the conventional empty-cell process, if desired, a modified full-cell cycle can be employed and a vacuum used of ¼ to ½ of 25 in. Hg as used in a full-cell process.

In a preferred embodiment, air is initially applied to the treating cylinder at a pressure sufficient to keep the treating solution weight pickup down to a level of 8 to 10 lbs. per cubic foot of wood.

While the temperature required to prevent or inhibit precipitation of water-borne salts (i.e. sludge formation) will depend upon such factors as the quantity of salts, impregnation conditions, and turnover rate at which the treating solution is expended, good results can generally be obtained by maintaining the work tank solution at between 40° F. and 70° F. Temperatures as high as 80° F., however, may be employed if the turnover rate is rapid, the quantity of salts is low and/or separation means is employed such as a centrifuge or filter to remove the sludge and the solution returned to the work tank. For best results a temperature of between about 45° F. and about 65° F. is employed, and most preferably between about 55° F. and 60° F. with a turnover rate of one month or less.

Typical empty-cell conditions can be employed such as are prescribed by the AWPA directive. A preferred procedure, however, is as follows:

| | | |
|---|---|---|
| Initial air | 10 psig | 15 min. |
| Fill | 10 psig | |
| Pressure up | 10–100 psig | 20–30 min. |
| Pressure hold | 100 psig | 2 hr. |
| Pressure release | 100–15 psig | 30 min. |
| Preservative back | 15 psig | |
| Residual pressure release | 15-atmospheric psig | |
| Final vacuum | 26 in. Hg | 2 hr. |

In addition to CCA solutions, other water-borne preservative solutions which form precipitates with wood sugars at high temperature can be employed in accordance with the invention. Typical examples include the chromium-containing formulations in the AWPA standards. Other, similar water-borne formulations which depend on solubilizing agents, such as ammonia, can also benefit from this invention.

A range of typical empty-cell conditions for the major portions of the cycle is as follows:

| | | |
|---|---|---|
| Initial air | atmospheric-100 psig | 0–120 min. |
| Pressure period | atmospheric-200 psig | ½–24 hr. |
| Final vacuum | atmospheric-26 in. Hg | ¼–4 hr. |

The range of the intermediate steps will depend on the equipment size and condition, species being treated, etc. and will vary considerably.

While the preceding description is illustrative of the invention, numerous and obvious variations will occur to one of ordinary skill in the art and thus the invention is intended to be limited only by the appended claims.

What is claimed is:

1. A wood pressure impregnation method comprising:

(a) placing wood in a treating vessel and subjecting the wood to a vacuum ½ of 25 in. Hg to a pressure above atmospheric of up to 100 psig for a period up to 2 hours (b) filling the vessel with a water-borne preservative salts treating solution that reacts at elevated temperatures with wood constituents to form difficulty soluble precipitates, said treating solution having a temperature of between about 40° F. and about 70° F. while maintaining the pressure of (a), (c) adjusting the full treating vessel to a positive pressure of between atmospheric and 200 psig, and holding this pressure until a predetermined amount of treating solution has been injected into the wood, (d) releasing the pressure and returning the treating solution to a storage vessel, whereby the precipitation of preservative salts is obviated or reduced, (e) removing the excess solution from the wood at a pressure of from atmospheric to 26 in Hg, and (f) recovering the wood.

2. The method of claim 1 wherein a preliminary vacuum is used of between ¼ and ½ of 25 in. Hg as used in a full-cell process.

3. The method of claim 1 wherein the initial air pressure used is only atmospheric air pressure.

4. The method of claim 1 wherein air is initially applied to the treating cylinder at a pressure sufficient to keep the treating solution weight pickup down to a level of from 8 to 10 lbs. per cubic foot of wood.

5. The method of claim 1 wherein the temperature is maintained between 40° F. and 70° F.

6. The method of claim 1 wherein the temperature is maintained between 45° F. and 65° F.

7. The method of claim 1 wherein the temperature is maintained between 55° F. and 60° F.

8. The method of claim 1 wherein the water-borne salts contain chromium.

9. The method of claim 1 wherein the water-borne preservative is a CCA solution.

10. The method of claim 1 wherein the major portions of the empty-cell cycle include: initial air pressure of atmospheric to 100 psig for up to 120 min., a positive pressure period of atmospheric to 200 psig for ½–24 hr. and a final pressure of atmospheric to 26 in. Hg for ¼–4 hr.

* * * * *